United States Patent [19]

Vermaat

[11] Patent Number: 4,898,374

[45] Date of Patent: Feb. 6, 1990

[54] INTERMITTENT DRIVE MECHANISM FOR COPY STACKING

[75] Inventor: David L. Vermaat, Port Crane, N.Y.

[73] Assignee: Imagitek, Inc., Binghamton, N.Y.

[21] Appl. No.: 211,561

[22] Filed: Jun. 27, 1988

[51] Int. Cl.[4] ..... B65H 29/40

[52] U.S. Cl. ..... 271/178; 271/209; 271/223

[58] Field of Search ..... 271/209, 220, 223, 224, 271/314, 178, 182, 207, 188

[56] References Cited

U.S. PATENT DOCUMENTS 1,752,648 4/1930 Matthews ..... 271/182
3,847,388 11/1974 Lynch ..... 271/220 X

FOREIGN PATENT DOCUMENTS 78761 6/1981 Japan ..... 271/314
183558 10/1983 Japan ..... 271/314
12453 1/1985 Japan ..... 271/314

*Primary Examiner*—Richard A. Schacher
*Attorney, Agent, or Firm*—Kane, Dalsimer, Sullivan, Kurucz, Levy, Eisele and Richard

[57] ABSTRACT

A stacking apparatus for a reproduction machine which can accommodate media sheets as greatly different sizes. An intermittent driving device is used so as to alterantely buckle and relax the sheet media thereby urging the sheet into various recesses which are formed in the apparatus so as to engage sheet media of various sizes.

3 Claims, 2 Drawing Sheets

INTERMITTENT DRIVE MECHANISM FOR COPY STACKING

BACKGROUND OF THE INVENTION

The present invention relates to a stacking and driving mechanism for output pages from a reproduction machine, particularly a wide-format reproduction machine.

In the reproduction arts, such as photocopying, an apparatus suitable for use in an office is typically designed to accommodate three sizes of paper in four different configurations—letter size (8¼ inches by 11 inches), legal size (8¼ inches by 14 inches), ledger size (9¼ inches by 12 inches), and letter size rotated ninety degrees. The desirability of having the resultant duplicate copies collected, sorted and collated is well-established by the abundance of office photocopy machines that offer these features.

However, in the reproduction arts, as the size and the range of sizes of the duplicates being handled increases, the versatility required of the transport mechanism, including the stacking mechanism, increases. This is particularly acute in wide-format engineering photocopy applications. Whereas the aforementioned typical office photocopy machine handles a range of paper sizes which varies in size by a ratio of two to one or less, the typical wide-format engineering photocopy machine is required to handle a range of paper sizes which varies by a ratio greater than sixteen to one.

For instance, when the duplicate paper is too long, the photocopy stacking mechanisms of the prior art had a tendency either to not transport the copy far enough into the receiving tray due to the increased surface area or to transport the copy too far into the receiving tray due to the protrusion of the trailing edge, thereby resulting in paper jamming and deformation.

Conversely, in the prior art, when the duplicates are significantly shorter than the receiving tray, the duplicate's trailing edge frequently is left in the path of the leading edge of subsequent documents. This results in paper jamming and deformation, or at the least, interleaving of the duplicates.

It is therefore an object of this invention to provide a stacking mechanism for reproduction machines, particularly wide-format engineering photocopy machines, which can accommodate a broad range of paper sizes.

It is a further object of this invention to provide a stacking mechanism that is reliable, simple and inexpensive.

SUMMARY OF THE INVENTION

The above and other beneficial objects and advantages are attained in accordance with the present invention by providing a driving mechanism including rollers, tires, "flap wheels" or similar components to effect an intermittent drive to the duplicate paper.

During the driving portion of the intermittent drive cycle, drive rollers in nip with a back-up surface or roller will force the media to form a slight buckle, storing energy in the media like a simple leaf spring. This stored energy due to the buckling will urge the leading edge of the media forward assuring that the leading edge abuts the end of the receiving tray. Next, the intermittent drive roller comes to the relaxation portion of its cycle. The roller then momentarily comes out of nip with its back-up surface, and releases the media, and the stored energy is released and the media relaxes back to its flat shape. This alternate driving and relaxing assures that the media is driven fully forward in a timely manner without causing any overdrive that might damage the media once it is driven fully forward into its receiving tray. This action further can be continuous, and doesn't require any feedback sensing and/or mechanism to cease the drive at an appropriate time.

The trailing edge of a very long sheet is directed so that it falls behind the area where the lead edges are introduced so as not to obstruct the leading edges of subsequent sheets.

Sheets of intermediate length are handled by providing one or more recesses for the trailing edge of the media to fall into, so as not to allow obstruction or interleaving with the leading edge of subsequent sheets.

Short sheets are handled effectively by the same mechanism in that these documents have their trailing edge guided into a protected zone or beneath a flap, guide, or platform. The buckle in the media due to the driving portion of the intermittent drive cycle provides the energy necessary to cause the trailing edge to jump or snap into this protected zone where its trailing edge will not be in the path of the leading edge of the subsequent sheet.

DETAILED DESCRIPTION OF THE PREFERRED EMBODIMENT

Figure 1:
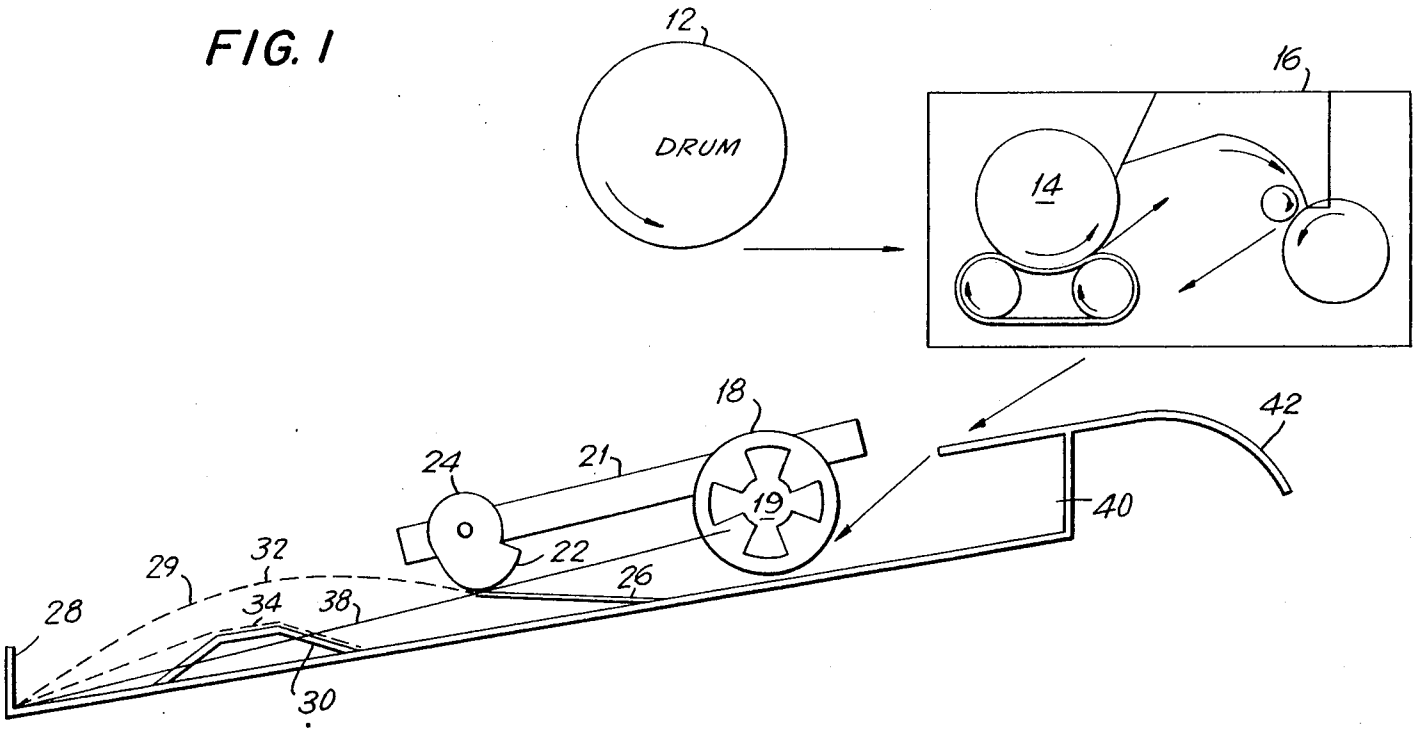
FIG. 1 is a side view partly in elevation of the apparatus in accordance with a preferred embodiment of the invention.
Figure 2:
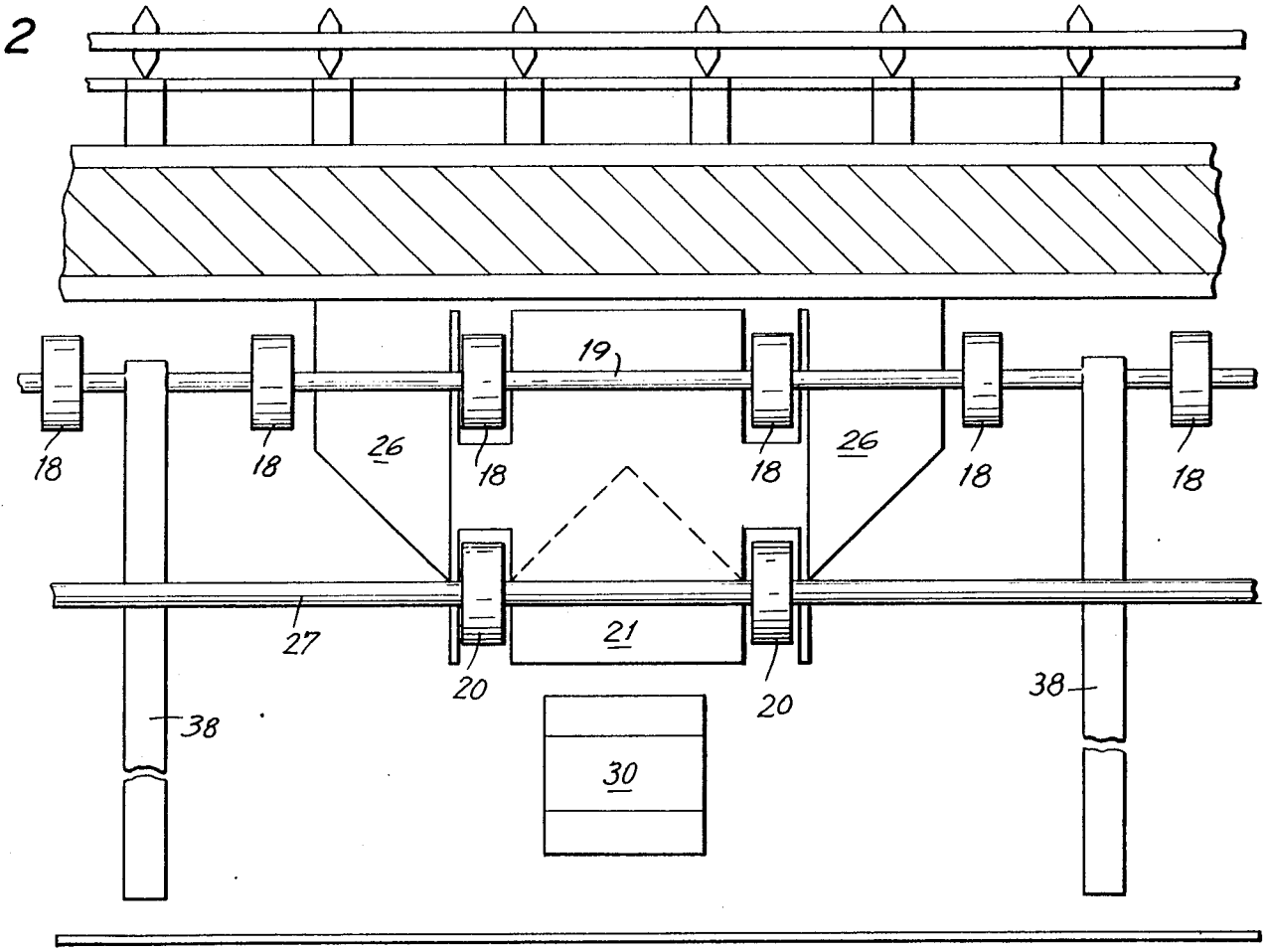
FIG. 2 is a top view partly in elevation in accordance with a preferred embodiment of the invention.

Reference is now made to the drawings wherein like numerals indicate like elements throughout the several views, and to FIG. 1 in particular wherein a side view of the stacking apparatus 10 is disclosed.

Typically, before finished media, such as paper, is stacked in the reproduction arts, the media is first processed by apparatus such as a drum 12, a fuser 14, and a transport means such as turn-around assembly 16. FIG. 1 includes turn-around assembly 16 such as disclosed in commonly assigned application serial number 166,930, filed March 11, 1988, "Copy Turn-Around Mechanism For Photocopy Machine".

Copy media exits transport means such as turn-around assembly 16 and enters apparatus 10, assisted by nudge tire 18. Nudge tire 18 is fixed to nudge axle 19 which is journalled for rotation and powered by an external source. Nudge tire 18 drives the media forward to buckler rollers 20. Buckler rollers 20 are intermittent drive rollers with an asymmetric radius, such that distal edge 22 forms a nip between buckler roller 20 and buckler nip guide 26 when distal edge 22 is directed downward thereby driving the media. However, when rotation of buckler roller 20 turns distal edge 22 upwards and proximal edge 24 downward, no nip is formed between buckler roller 20 and buckler nip guide 26. Buckler rollers 20 are fixed to drive axle 27 which is journalled for rotation and powered by an external source. This provides a period of driving and a period of relaxation for each rotation of buckler roller 20. Upper guide 21 provides an axis for buckler roller 20 and deters the trailing edge of the media from following the buckler roller 20 in an upward direction. The relative arcs of the distal edge 22 and the proximal edge 24 may be adjusted as the application warrants.

When the leading edge of the media is driven forward sufficiently to abut exit tray stop 28 of receiving tray 29, a subsequent driving cycle of buckler roller 20 forms a buckle in small size media as shown in path 32. Buckle assist guide 30 assures that the buckle is upwardly convex. The amount of linear drive surface of distal edge 22 on buckler roller 20 is proportional to the length needed to form a buckle in small size media (commonly known in the art as size A and B media) so that the trailing edge of the media is flipped back under buckler nip guide 26 during a relaxation (non-driving) cycle as buckler roller 20 as shown by path 34. This safely positions the trailing edge of small size media allowing the leading edge of subsequent media sheets to feed into receiving tray 29 unobstructed.

When handling a large size media, such as size C paper in wide format engineering copy applications, the media exits transport means such as turn-around assembly 16 and enters apparatus 10, assisted by nudge tire 18 and buckler roller 20 until the media abuts tray stop 28 of receiving tray 29. Paper hold down guides 38 break the beam of the media from leading to trailing edge. This is different from the previously described handling of the smaller sized A and B media wherein the beam is broken from side to side by buckle assist guide 30.

This configuration prevents the buckler rollers 20 from feeding media past the tray stop 28. Paper hold down guides 38 further prevent the feeding of the media past the tray stop 28 in that guides 38 limit the deformation of the media. The trailing edge of C size paper comes to rest in recess 40 and is held down therein by nudge tire 18. This protects the leading edge of subsequent media sheets from being obstructed by the trailing edge of the media sheet and prevents subsequent sheets from interleaving.

The trailing edges of media sheets too large to come to rest in recess 40, such as media sheets larger than 'C' size, exit from a transport mechanism such as turn-around mechanism 16 to drape over lip 42. This configuration keeps the trailing edge of even very large media sheets from obstructing the leading edges of subsequent media sheets.

Thus, in accordance with the above, the aforementioned objects are effectively attained.

What is claimed is:

1. A stacking apparatus for sheet media including an intermittent drive means comprising a drive wheel with a first circumferential portion at a proximal radius, and a second circumferential portion at a distal radius, said distal radius being greater than said proximal radius, said distal radius being chosen so as to form a nip with a guiding means thereby providing a driving period of the sheet media during rotation of said drive wheel, said proximal radius being chosen so as to not form a nip with said guiding means thereby providing a relaxation period for the sheet during rotation of said drive wheel;

a first lower recess in a path of the sheet media subsequent to said intermittent drive means to receive a trailing edge of a first sheet media of a first length thereby not obstructing the leading edge of subsequent sheet media;

nudging means in said path of the sheet media prior to said intermittent drive; and a second lower recess in said path of the sheet media prior to said nudging means to receive a trailing edge of the first sheet media of a second length, said second length being greater than said first length, thereby not obstructing the leading edge of a subsequent sheet media.

2. The stacking apparatus of claim 1 wherein said first lower recess further comprises a means for breaking a beam of the sheet media.

3. The stacking apparatus of claim 1 further comprising a draping means in said path of the sheet media prior to said second lower recess to receive a trailing edge of the sheet media of a third length, said third length being greater than said second length, thereby not obstructing the leading edge of a subsequent sheet media.

* * * * *